US012428945B2

(12) United States Patent
Al-Otaibi et al.

(10) Patent No.: US 12,428,945 B2
(45) Date of Patent: Sep. 30, 2025

(54) AUTONOMOUS INJECTION CHOKE SYSTEM FOR GAS LIFT WELLS

(71) Applicant: SAUDI ARABIAN OIL COMPANY, Dhahran (SA)

(72) Inventors: Hazza G. Al-Otaibi, Dhahran (SA); Marcelo A. Ramos Flores, Udhailiyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 259 days.

(21) Appl. No.: 18/159,367

(22) Filed: Jan. 25, 2023

(65) Prior Publication Data

US 2024/0247571 A1 Jul. 25, 2024

(51) Int. Cl.
*E21B 44/00* (2006.01)
*E21B 43/12* (2006.01)

(52) U.S. Cl.
CPC ..... *E21B 44/00* (2013.01); *E21B 43/122* (2013.01); *E21B 2200/02* (2020.05)

(58) Field of Classification Search
CPC ..... E21B 34/025; E21B 43/122; E21B 43/123
See application file for complete search history.

(56) References Cited

U.S. PATENT DOCUMENTS

| | | | | |
|---|---|---|---|---|
| 9,031,674 | B2 | 5/2015 | Rasid et al. | |
| 10,138,724 | B2 | 11/2018 | Querales et al. | |
| 2014/0039793 | A1* | 2/2014 | Querales | E21B 43/122 702/6 |
| 2018/0283137 | A1* | 10/2018 | Peyregne | E21B 34/025 |
| 2021/0340828 | A1* | 11/2021 | Charles | E21B 21/08 |

FOREIGN PATENT DOCUMENTS

| | | | | |
|---|---|---|---|---|
| WO | WO-0079098 | A1 * | 12/2000 | E21B 43/12 |

* cited by examiner

*Primary Examiner* — Kristyn A Hall
(74) *Attorney, Agent, or Firm* — Vorys, Sater, Seymour and Pease LLP

(57) ABSTRACT

A method of calibrating gas lift injection for a gas lift well includes incrementally adjusting an operational position of a gas lift choke arranged within a gas lift injection line, the gas lift injection line being in fluid communication with an annulus defined between production tubing and an inner wall of a wellbore, and the gas lift choke being operable to control a flowrate of a lift gas injected into the annulus, monitoring changes in a real-time downhole pressure within the gas lift well as the operational position of the gas lift choke is adjusted, determining an optimized operational position of the gas lift choke based on a lowest downhole pressure and a corresponding operational position of the gas lift choke when the lowest downhole pressure is observed, and adjusting the operational position of the gas lift choke to the optimized operational position.

19 Claims, 3 Drawing Sheets

AUTONOMOUS INJECTION CHOKE SYSTEM FOR GAS LIFT WELLS

FIELD OF THE DISCLOSURE

The present disclosure relates generally to gas lift wells and, more particularly, to the use of an autonomous choke to optimize injection of lift gas into a producing well.

BACKGROUND OF THE DISCLOSURE

Methods of artificial lift are commonly utilized within the oil and gas industry to optimize performance and maximize production of hydrocarbon producing wells. Gas lift is one such method, and utilizes the injection of high pressure gas to assist in lifting formation fluids (e.g. hydrocarbons, formation water, or some combination thereof) to surface for production. Manipulation of the gas injection choke for a gas lift well results in either a continuous or intermittent feed of lift gas dependent upon the operation and requirements of the well. The injected gas lowers the density of the fluid within the production tubing, resulting in a reduced downhole hydrostatic pressure. The pressure differential between wellbore downhole pressure and the formation reservoir pressure results in the well's ability to efficiently flow hydrocarbons to surface; i.e., a higher pressure differential potentially results in a higher production rate.

Gas lift operations are not often best optimized in terms of the volume of lift gas injected nor in the amount of formation fluids produced. Optimization occurs at a point in which a minimum amount of lift gas is injected but results in the maximum amount of produced formation fluid. This often requires continuous manual review of well performance data and surface parameters to determine a potential optimum gas injection point. Consequently, the gas lift choke may require frequent adjustment to attain the optimum gas injection point. In many instances however, the optimization point, is never met or not maintained as parameters continue to change, often with great regularity. Gas injection outside of the optimum injection point may result in a missed opportunity to achieve the greatest potential production rate and may simultaneously result in increased energy costs due to an over injection of externally sourced and compressed lift gas.

A gas lift system that is less labor intensive and more reliable in achieving the gas injection optimization point(s) would result in higher production rates and reduced cost for wells utilizing gas lift.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a method of calibrating gas lift injection for a gas lift well may include incrementally adjusting the operational position of a gas lift choke arranged within a gas lift injection line, wherein the gas lift injection line may be in fluid communication with an annulus defined between production tubing and an inner wall of a wellbore and the gas lift choke may be operable to control the flowrate of a lift gas injected into the annulus. The method may further include monitoring changes in real-time downhole pressure within the gas lift well as the operational position of the gas lift choke is adjusted and determining an optimized operational position of the gas lift choke based on a lowest downhole pressure and a corresponding operational position of the gas lift choke when the lowest downhole pressure is observed. Additionally, the method may include, adjusting the operational position of the gas lift choke to the optimized operational position.

According to another embodiment consistent with the present disclosure, a well system may include a wellbore that penetrates a hydrocarbon-bearing formation and production tubing extended into the wellbore that may be in fluid communication with formation fluids emanating from the hydrocarbon-bearing formation. The well system may further include a gas lift choke arranged within a gas lift injection line, wherein the gas lift injection line may be in fluid communication with an annulus defined between the production tubing and an inner wall of the wellbore, and the gas lift choke may be operable to control a flowrate of a lift gas injected into the annulus. Additionally, the well system may include a remote terminal unit (RTU) that receives real-time downhole pressure measurements and a real-time operational positions of the gas lift choke. Further, the well system may include a computer system that receives the real-time downhole pressure measurement and the real-time operational position of the gas lift choke from the RTU, wherein the computer system may include one or more processors and a memory for storing data and computer-readable instructions executable by the processors. Accordingly, the computer system may be programmed to process the real-time downhole pressure measurement and the real-time operational position of the gas lift choke. The computer system may also be programmed to determine an optimized operational position of the gas lift choke based on a lowest downhole pressure and a corresponding operational position of the gas lift choke when the lowest downhole pressure is observed. Lastly, the computer may be programmed to send a command signal to the gas lift choke to adjust the operational position of the gas lift choke to the optimized operational position of the gas lift choke once the lowest downhole pressure is observed.

According to another embodiment consistent with the present disclosure, a non-transitory, computer readable medium programmed with computer executable instructions that, when executed by a processor of a computer system, may perform a method of calibrating gas lift injection for a gas lift well, the method may include incrementally adjusting the operational position of a gas lift choke arranged within a gas lift injection line wherein the gas lift injection line may be in fluid communication with an annulus defined between production tubing and an inner wall of a wellbore, and the gas lift choke may be operable to control a flowrate of a lift gas injected into the annulus. The method may further include monitoring changes in a real-time downhole pressure within the gas lift well as the operational position of the gas lift choke is adjusted. Additionally, the method may include determining an optimized operational position of the gas lift choke based on a lowest downhole pressure and a corresponding operational position of the gas lift choke when the lowest downhole pressure is observed. Lastly, the method may include adjusting the operational position of the gas lift choke to the optimized operational position.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
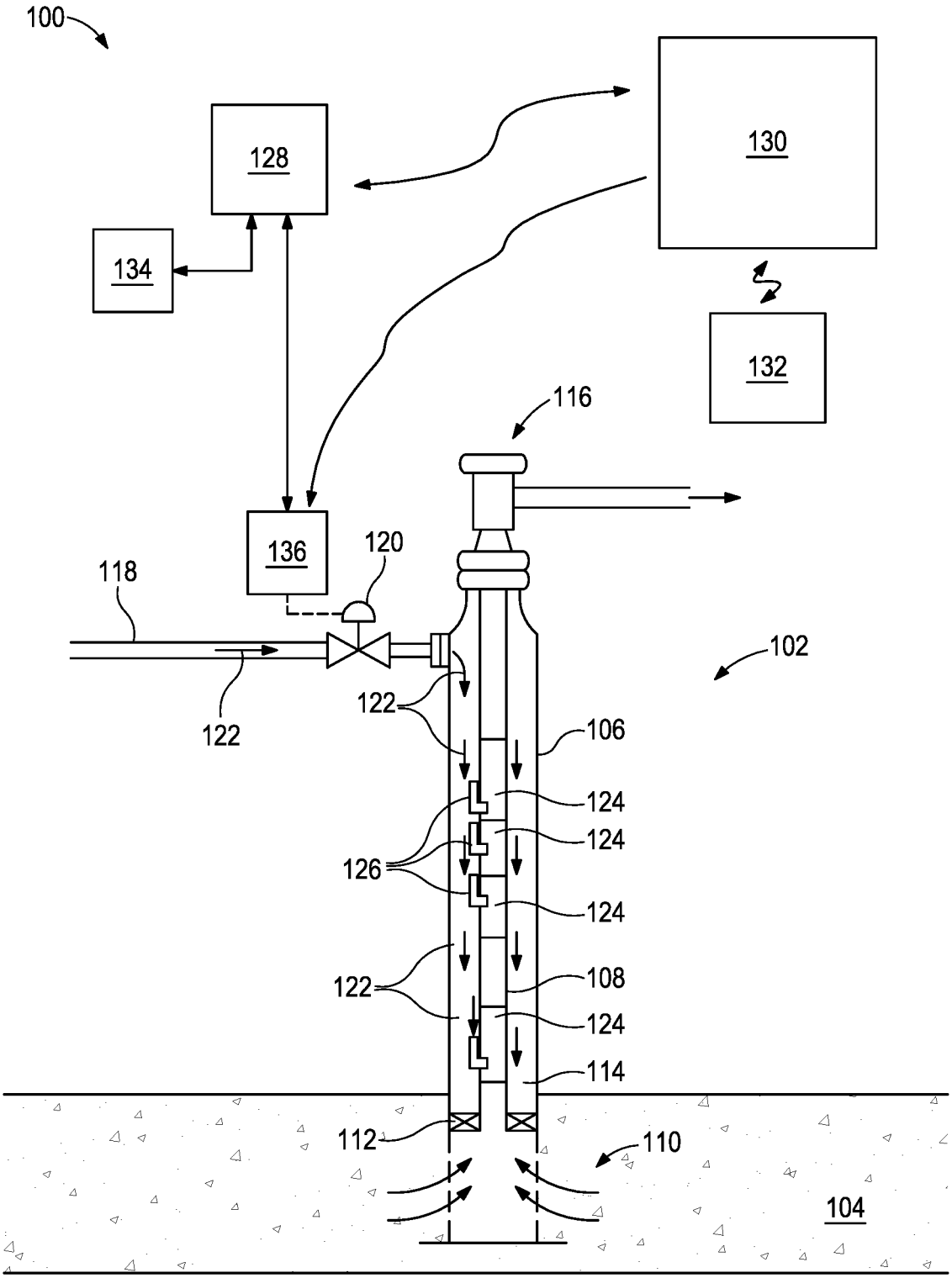
FIG. 1 is a schematic diagram of an example well system that may incorporate the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to optimization of gas injection into gas lift wells and, more particularly, to an autonomous gas lift choke system for determining an optimized gas injection rate and injecting lift gas into a hydrocarbon producing well at the optimized gas injection rate. According to the system and methods disclosed herein, the gas injection choke may be autonomously adjusted without manual or remote manipulation to optimize the gas injection rate relative to the lowest downhole pressure observed in the wellbore. The gas lift choke may be in communication with a computer system programmed to determine and recognize the optimum lift gas injection point, which correlates to the point where the pressure differential between downhole pressure and the reservoir pressure is highest. The gas lift injection choke may then be adjusted to obtain and maintain the optimum gas injection point.

Production engineers often utilize historical data as well as geological properties to generate models that estimate gas injection for hydrocarbon production optimization. In some cases, when such models are implemented the resultant effect is an over or under estimation of gas injection volume. Incorrect estimations may be problematic where external sources of injectable lift gas is limited and energy costs to operate gas compressors is high. Additionally, while there is means to monitor real-time parameters and accordingly make gas injection choke adjustments, such operations often require significant manual oversight and troubleshooting on the part of production engineers and/or operators, which is often prone to error. The systems and methods described herein may be advantageous in lessening the amount of estimation error and reducing the amount of engineer/operator oversight. Production optimization is better achieved with a system that can self-adjust gas lift injection based on constantly changing well conditions.

FIG. 1 is a schematic diagram of an example well system 100 that may embody or otherwise employ one or more principles of the present disclosure. In the illustrated embodiment, the well system 100 includes components of a gas lift system installed within a hydrocarbon producing wellbore 102 that extends through various layers of earth strata and into a hydrocarbon producing formation 104 (hereafter referred to as the "formation 104").

As illustrated in FIG. 1, the wellbore 102 can be lined with a string of casing 106 that extends into the formation 104. The casing 106 includes a plurality of perforations 110 that provide conduits through which formation fluids (e.g., oil, gas, formation water, or some combination thereof) can migrate from the formation 104 and into the wellbore 102. A string of production tubing 108 may be extended into the wellbore 102 (i.e., into the casing 106), and may provide a conduit for extracted formation fluids from the formation 104 to flow to the well surface. In the present embodiment, the casing 106 extends to the distal end of the wellbore 102. In other embodiments, however, the casing 106 may not extend to the bottom of the wellbore 102. Instead, some portion (or portions) of the producing formation 104 may be left exposed, as is the case in open hole completions. In yet other embodiments, the casing 106 may be entirely omitted from the well system 100, without departing from the scope of the disclosure.

The production tubing 108 may be operatively coupled to a production packer 112 positioned and set some predetermined distance above (uphole from) the perforations 110 of the formation 104. The production packer 112 may be axially secured within the casing 106, thereby isolating an annulus 114 above the packer 112 and defined between the inner radial surface of the casing 106 and the exterior radial surface of the tubing 108. The production packer 112 may be set by means known by those of ordinary skill in the art such that it sealingly engages the inner radial surface of the casing 106 and the outer radial surface of the production tubing 108, thereby creating a barrier that prevents fluid flow from below the packer 112 and into the annulus 114, and similarly prevents fluids circulating within the annulus 114 from flowing below the production packer.

The well system 100 further includes a wellhead 116 arranged atop the wellbore 102. While not shown, the wellhead 116 configuration can include one or more previously installed casing head housings and a tubing head housing, as required by the wellbore 102 design.

The well system 100 further includes a gas lift injection line 118 in fluid communication with the wellhead 116, and a gas lift choke 120 (alternatively referred to as "the choke 120") may be arranged within the gas lift injection line 118. The gas lift injection line 118 is a conduit that operatively connects an external source of high pressure gas (not shown) to the wellhead 116 for injection into the wellbore 102, and more particularly, into the annulus 114. One or more gas compressors or pumps (not shown) may be operable to pressurize and convey pressurized lift gas 122 into the gas lift injection line 118, which then conveys the lift gas 122 into the annulus 114 via the wellhead 116. In a circuitous system, the gas compressors serve to compress a predetermined portion of produced gas obtained from the formation 104 for injection back into the annulus 114.

Examples of the lift gas 122 include, but are not limited to, carbon dioxide, produced natural gas (e.g., a mixture of methane and ethane), nitrogen, or any combination thereof. Produced natural gas may be sourced from an oil and gas well, requiring surface separation and compression before injection as lift gas 122. Alternatively, wells producing natural gas exclusively may provide the necessary source of lift gas 122 without requiring surface separation. In determining the source and type of lift gas 122, it may be advantageous to consider the potential interaction between the produced hydrocarbon (e.g. oil) and the lift gas 122 so as not to generate scale or hazardous gases.

The gas lift choke 120 is arranged within the gas lift injection line 118 and is operable to control the volume and rate (flowrate) of the lift gas 122 being injected into the annulus 114. Accordingly, manipulating (operating) the choke 120 permits high pressure lift gas 122 (alternatively referred to as "pressurized lift gas 122") to enter the wellhead 116 at a predetermined flow rate, which directs the lift gas 122 into the annulus 114. The operational position of the choke 120 (i.e., the percentage of which the choke 120 is fully open or closed) may be manipulated to ensure proper injection of the lift gas 122. More particularly, it is desirable to inject the lift gas 122 at an optimum injection point, which corresponds to the point at which the lowest downhole pressure is observed during a choke calibration operation. Accordingly, the operational position of the choke 120 is frequently adjusted during the lifetime of the well in an attempt to continuously obtain the optimum injection point.

According to embodiments of the present disclosure, operation of the gas lift choke 120 may be automated to enhance and optimize the economic performance of the system 100 by maintaining a minimum injection gas-to-produced liquid ratio, which corresponds to the minimum power associated with recycled gas compression. Optimizing the injection rate of the lift gas 122 at the choke 120 maximizes the production rate with the least amount of lift gas 122 injected downhole. Accordingly, the gas lift choke 120 described herein may be autonomously regulated and adjusted. Following system calibration, which is discussed in further detail below, the operational position of the gas lift choke 120 may be automatically adjusted in accordance with calibration and real-time operating data. The real-time data that may be influential to positioning adjustments for the gas lift choke 120 include, but are not limited to, downhole pressure, wellhead pressure, downhole temperature, wellhead temperature, flow rate and pressure of the lift gas 122, produced oil rate, produced gas rate, produced water rate, current positions of gas lift choke 120 and production line choke, and the like. Advantageously, the operational position of the gas lift choke 120 may be adjusted without input from a well operator and without required oversight by the well operator. Rather, the gas lift choke 120 is configured to self-adjust to maintain position based upon a predetermined and preprogrammed variance threshold that encompasses the optimum injection point.

Notwithstanding the foregoing, in some embodiments, the gas lift choke 120 may be manually manipulated and adjusted by the operator. In yet other embodiments, the gas lift choke 120 may be remotely manipulated or adjusted by the operator, as needed. In such embodiments, the operator may implement position adjustments to the choke 120 by means of software enabled user commands, which are transmitted to the gas lift choke 120, a method of which will be provided in this disclosure.

As shown in FIG. 1, the production tubing 108 may further include one or more gas lift mandrels 124, and each gas lift mandrel 124 may include at least one gas lift valve 126. The gas lift mandrels 124 and valves 126 may be strategically positioned along the length of the production tubing 108 as operationally effective and appropriate for the wellbore 102 configuration. When operationally required, pressurized lift gas 122 is introduced into the annulus 114 via continuous or intermittent injection. Those skilled in the art will be familiar with methods of continuous and intermittent lift gas injection. The gas lift valves 126 permit the lift gas 122 to enter the production tubing 108, while simultaneously preventing fluid inside the tubing 108 (i.e., a mixture of produced formation fluid and injected lift gas) from migrating into the annulus 114.

Injecting the lift gas 122 into the tubing 108 effectively reduces the density of the production fluids flowing up through the production tubing 108 and accordingly, reduces the wellbore 102 bottom hole hydrostatic pressure. The reduction in bottom hole pressure increases the pressure differential between the wellbore 102 and the reservoir (i.e., the formation 104), thus resulting in an increased production rate of formation fluid to surface.

According to embodiments of the present disclosure, the system 100 may further include a remote terminal unit or "RTU" 128, a computer system 130, and a workstation 132. The RTU 128 may serve as a data collection point for data and measurements acquired from sources within the system 100. More specifically, the RTU 128 may capture data from sensors (downhole and surface), downhole tools (permanent or temporary), and the like. Examples of downhole data collected from within the wellbore 102 may include, but are not limited to, downhole pressure and bottom hole temperature. Examples of collected surface data include ambient temperature, gas compressor output pressure, lift gas pressure, tubing head pressure, operational position of the gas lift choke 120, wellhead pressure, wellhead temperature, flow rate and pressure of the lift gas 122, produced oil rate, produced gas rate, produced water rate, and similar. Downhole and surface data transmitted to the RTU 128 is limited only by the type and quantity of measurement devices/sensors the operator chooses to install.

In the present embodiment, the data collected by the RTU 128 can include measurements acquired by a permanent downhole monitoring system (PDHMS) included in the system 100. In this example, the PDHMS data includes permanent downhole pressure and temperature gauges (not shown) that record downhole pressures and temperatures continuously. Once transmitted to the RTU 128 at the surface, the measurements may be available and visible to the operator by means of a PDHMS panel 134 communicably connected to the RTU 128. Means of connection between the RTU 128 and the PDHMS panel 134 may be via fiber optic cable, wired cable, wireless connection, or some combination thereof, as well as by any other known means.

In some embodiments, the RTU 128 may be communicably connected to the gas lift choke 120 and, more particularly, to a servo or motor 136 operatively coupled to the choke 120. The RTU 128 may communicate with the motor 136 via any wired or wireless communication means capable of transmitting operational position and/or command signals between the RTU 128, the motor 136, and the gas lift choke 120. Accordingly, the operational position of the gas lift choke 120 may be communicated to the RTU 128.

Further, the RTU 128 may be communicably connected to the computer system 130 such that the data collected at the RTU 128 may be transmitted to the computer system 130 for processing. The RTU 128 may communicate with the computer system 130 via any wired or wireless communication means, and the computer system 130 may include one or more system processors and a memory for storing data and computer-readable instructions executable by the processors. In the present embodiment, the computer system 130 utilizes system processors to enable software used to monitor, trouble-shoot, and/or optimize operation of the system 100. Optimization includes adjusting the operational position of the gas lift choke 120 to optimize the injection rate of the lift gas 122, which maximizes production rate with the least amount of injected lift gas 122.

Accordingly, communication between the RTU 128 and the computer system 130 enables the transmission of the data collected by the RTU 128 to the computer system 130. Based upon the transmitted data, the computer system 130 may create a model that generates an optimum lift gas 122 injection point. In some embodiments, the computer system 130 may be communicably connected to the servo or motor 136 via any wired or wireless communication means capable of transmitting command signals. As a consequence, the computer system 130 may transmit commands directly to the motor 136 to physically adjust the operational position of the gas lift choke 120. Communication between the computer system 130 and the motor 136 allows the computer system 130 to selectively adjust the operational positions of the choke 120 to meet the optimum lift gas 122 injection point as determined by the generated model. Consequently, the desired lift gas 122 rate may be continuously adjusted to meet the targeted optimum lift gas 122 injection rate. Continuous adjustment may be advantageous as ambient temperature can vary throughout the day resulting in minor lift gas 122 injection rate differences. Alternatively, the computer system 130 may be programmed with (or otherwise generate) a target oil production rate. The gas lift choke 120 may be positioned in accordance with maintaining the target oil production rate, which may be below the model generated optimum lift gas 122 injection point. In either case, the choke 120 should never be positioned so as to exceed the optimum lift gas 122 injection rate unless for data gathering and calibration purposes (discussed below). In at least one embodiment, it is contemplated herein that the computer system 130 communicate with the RTU 128, and the RTU 128 may be configured and otherwise operable to communicate command signals to the motor 136 and thereby selectively adjust the operational position of the choke 120.

The computer system 130 may also enable the functionality of a supervisory control and data acquisition system (SCADA). The SCADA system enables the operator to manipulate connected components, process data, maintain event logs, and the like. More particularly, the connection between the computer system 130 and the RTU 128, as well as the use of the SCADA system, permits the operator to make adjustments to the operational position of the gas lift choke 120 via transmitted commands sent to the motor 136.

The workstation 132 may include a means for operator input (e.g., a keyboard, a graphical user interface or "GUI", or the like) and a means for display (e.g. a computer monitor or screen), such that an operator may view, process, and manipulate the data collected from the wellbore 102 and otherwise interact with the system software of the computer system 130. The operator has the option to interact with the software via a general processor embedded within the workstation 132, or by means of the system processor included in the computer system 130. More specifically, by means of either processor, the operator may monitor, trouble-shoot, and or optimize operation of the system 100 and facilitate autonomous adjustment of the operational position of the gas lift choke 120.

Following the initial unloading of the wellbore 102, a process generally known in gas lift well preparation operations, the computer system 130 may be programmed and otherwise configured to undergo a calibration process to ensure that the operational position of the gas lift choke 120 is adjusted for optimized injection of the lift gas 122. In some embodiments, calibration of the computer system 130 may be undertaken on a monthly basis (e.g., every 30 days), but could alternatively be undertaken at time intervals that are longer or shorter than a month, and generally dependent upon the requirements of the well and the well operator.

Prior to calibration, however, it may be advantageous to determine whether lift gas 122 injection is necessary. Accordingly, following the unloading of the wellbore 102, the gas lift choke 120 may be fully closed (e.g., 0%) while the production choke (not shown) emplaced within the wellhead 116, may be incrementally opened from a fully closed position (e.g., 0%) to a fully opened position (e.g., 100%). If lift gas 122 injection is deemed required (i.e., the natural reservoir pressure of the wellbore 102 is unable to lift oil and/or gas to surface for production) the gas lift choke 120 may be calibrated for optimum lift gas 122 injection.

During calibration, software stored in the computer system 130 triggers incremental adjustments of the gas lift choke 120 across a range of operational positions; i.e., between fully closed and fully open (while the production choke is in a fully opened position). Simultaneously, real-time readings of the downhole pressure within the wellbore 106 are acquired by the pressure sensors included in the PDHMS.

In some calibration embodiments, the gas lift choke 120 may be adjusted from a fully closed position (e.g., 0%) and opened gradually in 5 minute increments (or in other increments suitable to the operator) while the corresponding real-time downhole pressures may be monitored and recorded. In determining the optimum point of lift gas 122 injection, the computer system 130 and/or operator will look for the operational position of the choke 120 at which the downhole pressure stabilizes. Stabilization may be deemed achieved when downhole pressure oscillations are less than a predetermined threshold. (The predetermined downhole pressure variance threshold may vary depending upon the specifics of the wellbore and otherwise.)

In some applications, the operator may input an operational positioning range for the gas lift choke 120 (e.g., between about 40% and about 70%) that is based upon prior modeling, geological data, and/or offset wells, or the like. In such embodiments, the operational position of the gas lift choke 120 will be adjusted between about 40% and about 70%, and corresponding real-time readings of the downhole pressure within the wellbore 102 will be recorded.

During calibration, both sets of data points (i.e., the real-time operational position of the choke 120 and the corresponding real-time downhole pressure) are transmitted to the RTU 128 and ultimately to the computer system 130. The computer system 130 may then process the collected data and generate a graphical representation or plot of the data, i.e. measured downhole pressure vs. position of the choke 120. The computer system 130 may then be programmed to determine an optimized operational position of the choke 120 based on the lowest downhole pressure and the corresponding operational position of the choke 120 when the lowest downhole pressure is observed or achieved. The operational position of the choke 120 when the lowest downhole pressure is observed corresponds to the highest production rate for the well, and thus represents the point of optimum injection of the lift gas 122.

Flow rate and downhole pressure are related in Darcy's law:

$$q = \frac{kA}{\mu}\frac{\Delta P}{L}$$

Where q=flow rate measured in volume/time, k=permeability of the formation 104, A=the cross-sectional area of the medium over which there is fluid passage, μ=the viscosity of the flowing fluid(s), ΔP=the pressure differential across the formation 104 through which fluid is flowing, and L=the length over which the pressure differential occurs. Based upon Darcy's Law, a higher pressure differential is indicative of a higher flow rate (q).

In accordance with the present disclosure, a greater pressure differential between the downhole pressure within the wellbore 102 and the reservoir pressure of the formation 104 is therefore ideal. Accordingly, a lower downhole pressure of the wellbore 102 relative to the pressure of the formation 104 increases the ability of the producing formation 104 to flow reservoir fluid through the perforations 110 and into the wellbore 102. As such, achieving and maintaining of the lowest observed bottom hole pressure is essential in attaining the highest rate of formation fluid production. Accordingly, determination of the optimum injection point and its maintenance, while simultaneously accounting for other downhole and surface factors that may affect it, is indicative of an optimized and efficient gas lift well.

Increasing the volume or flow rate of the lift gas 122 beyond that which is required to obtain the optimum injection point may adversely affect the minimum injection gas to produced liquid ratio. Additionally, injecting the lift gas 122 beyond the point of optimum injection will inject amounts of lift gas 122 not needed for optimum production, thus resulting in economic inefficiency. The operator must consider the energy requirements and costs associated with gas compression. An over injection of the lift gas 122 may result in increased cost that is not proportional to the production rate of formation fluid.

Outside the pre-planned or scheduled calibration processes, the computer system 130 may further be programmed to make periodic, incremental, and controlled positioning adjustments to the gas lift choke 120 so as to maintain the position of the gas lift choke 120 as close as reasonably possible to the optimum injection rate for the system 100. In situations where maintenance of the optimum injection rate is not feasible, and so as not to exceed the optimum injection rate, the computer system 130 may be programmed to maintain a threshold daily lift gas 122 injection rate. Accordingly, the gas lift choke 120 may be programmed to make operational position changes to maintain a lift gas 122 injection rate of about +/−50,000 SCF/day. More specifically, the system 130 may be configured to continuously or periodically analyze real-time changes to the downhole and surface data transmitted to the RTU 128 and send command signals to adjust the operational position of the choke 120 as necessary to maintain optimum injection of the lift gas 122.

Additionally, incremental adjustments to the operational position of the gas lift choke 120 may be made if the computer system 130 recognizes and otherwise determines a change in the pressure of the lift gas 122 conveyed within the gas lift injection line 118 and prior to reaching the gas lift choke 120. Changes in the pressure of the lift gas 122 prior to reaching the gas lift choke 120 may reflect changes in the outlet pressure of the compressors or pumps that supply the lift gas 122 to the gas lift injection line 118. Changes to the compressor outlet pressure may occur, for example, as a result of routine maintenance or failure of the compressor, which would affect the supply and pressure of the lift gas 122.

Figure 2:
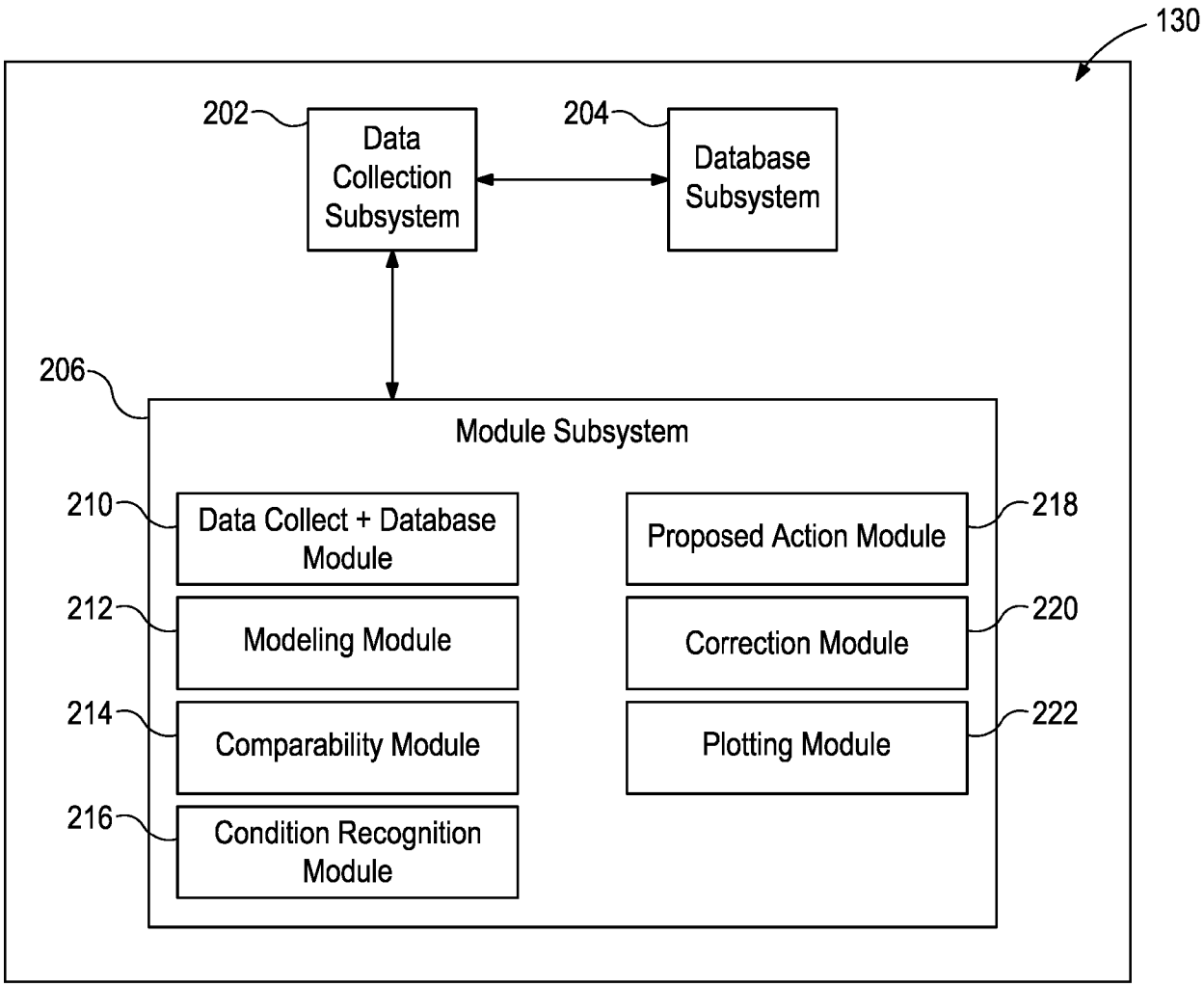
FIG. 2 is a schematic diagram of an example computer system that may be incorporated into the well system of FIG. 1, according to one or more embodiments of the present disclosure.

FIG. 2 is a schematic diagram of the computer system 130, according to one or more embodiments of the present disclosure. The computer system 130 can be implemented on one or more general purpose networked computer systems, embedded computer systems, routers, switches, server devices, client devices, various intermediate devices/nodes or standalone computer systems. Additionally, computer system 130 can be implemented on various mobile clients such as, for example, a handheld tablet, personal digital assistant (PDA), a laptop computer, a pager, and the like, provided it includes sufficient processing capabilities. In the present example, the computer system 130 is enabled within the servers of the computer system 130 (FIG. 2).

Computer system 130 includes one or more subsystems. In the present embodiment, the computer system 130 includes a data collection subsystem 202, a database subsystem 204, and a module subsystem 206. The data collection subsystem 202 collects wellbore data and, more particularly, real-time downhole and surface data as transmitted to and received by the RTU 128 (FIG. 1). As discussed previously, the real-time downhole and surface data may include downhole pressure measurements and the current operational position of the gas lift choke 120 (FIG. 1).

The database subsystem 204 serves as an operator-accessible data repository. The database subsystem 204 may receive collected data transmitted from the data collection subsystem 202, and the received data may then be stored for future operator use, or more broadly, for future use by the self-adjusting gas lift choke 120 itself.

The module subsystem 206 may include software modules enabling functionality of the computer system 130. In the present embodiment, the module subsystem 206 includes a data collect and database module 210, a modeling module 212, a comparability module 214, a condition recognition module 216, a proposed action module 218, a correction module 220, and a plotting module 222. The software modules introduced in this disclosure are not intended to be limiting and includes the software modules necessary to perform the method(s) of the present embodiment. As such, in other embodiments, the operator may add or remove software modules in accordance with the particular needs of a specific well or more broadly, to address the needs of a multi-well field.

The data collect and database module 210 enables the transfer of data from the data collection subsystem 202 to the database subsystem 204 for retention within the database, as discussed above. In some embodiments, the operator will generate well models and predictive lift gas injection curves based on geological data, offset wells, and or any other applicable data. These models may then be input into the computer system 130 via modeling module 212. The predictive models are then compared to the real-time collected data (as enabled by the data collect and database module 210) within the comparability module 214. Any discrepancies between the collected data and the predictive model data may be identified by the condition recognition module 216. The condition recognition module 216 utilizes the discrepancies in ascertaining the potential reason for the discrepancy and in presenting to the operator a potential forward action. Based upon the output of the condition recognition module 216 the proposed action module 218 provides the operator potential actions and or inputs that may be selected to optimize the computer system 130. More particularly, the proposed action module 218 provides recommended actions calculated by the computer system 130 as likely to produce gas lift operation optimization within some predetermined threshold. Additionally, the condition recognition module 216 may be used during the calibration period to identify the optimum injection point.

Referring again briefly to FIG. 1 with continued reference to FIG. 2, adjustments are made to the operational position of the choke 120 to obtain the optimum injection point. In the present example, the motor 136 is operable to adjust the position of the gas lift choke 120 based upon the outputs generated by the proposed action module 218. The SCADA, enabled by the system processors of the computer system 130, transmits the position command without the need for manual or remote input from an operator.

In some embodiments, the operator may utilize the recommended actions of the proposed action module 218 to make manual adjustments to the choke 120. In yet other embodiments, recommended adjustments to the choke 120 may be made remotely via the SCADA system as commanded by the operator. In such an example, the operator may enter a desired operational position for the choke 120 via the workstation 132 by means of an input device. The real-time operational position of the choke 120 may then be transmitted by the SCADA system to the RTU 128, and the RTU 128 relays the positioning command for the choke 120, as directed by the SCADA system, to the motor 136, which is operable to physically adjust the operational position of the gas lift choke 120.

Referring again to FIG. 2, the correction module 220 may be programmed to make updates to the plot generated by the computer system 130 based on the collected data. The correction module 220 will also account for any modifications/adjustments made based upon the operator's actions after receiving indication of discrepancy from the condition recognition module 218.

The plotting module 222 generates performance curves based on the updated model that may be graphically presented to the operator in the form of a plot. Similarly, the operator may utilize the plotting module 222 for real-time operational needs, trouble-shooting, or similar. The proposed action module 218 provides the operator potential actions and or inputs that may be selected to optimize operation of the system 100 (FIG. 1). More particularly, the proposed action module 218 provides recommended actions calculated by the computer system 130 as likely to produce gas lift operation optimization within some predetermined threshold.

Figure 3:
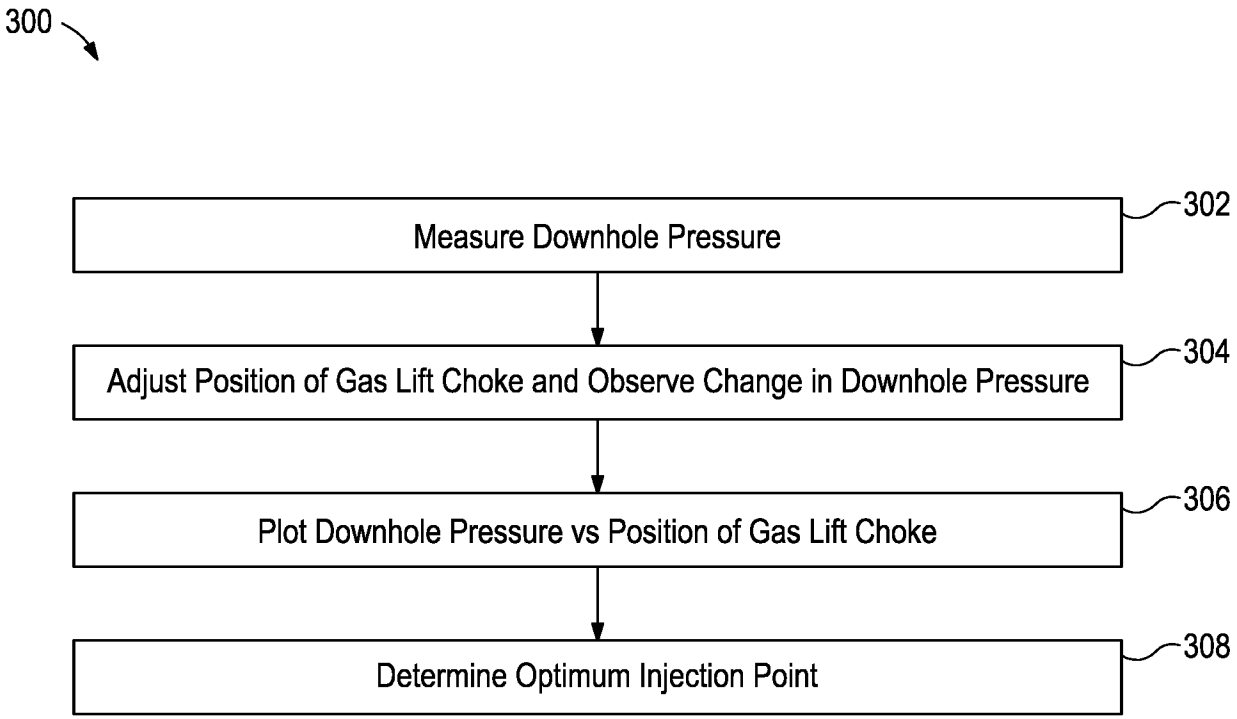
FIG. 3 is a schematic flowchart of an example gas lift choke calibration method, according to one or more embodiments of the present disclosure.

FIG. 3 is a schematic flowchart of an example calibration method 300 to determine an optimum lift gas injection point, according to one or more embodiments. The calibration method 300 may be performed and repeated on a predetermined timeline, such as every month (e.g., 30 days), but could alternatively be implemented at intervals greater than or less than monthly, or via a frequency determined by the operator. The calibration method 300 may include measuring a real-time downhole pressure, as at 302. The real-time downhole pressure measurement may be acquired via the PDHMS downhole sensor(s), as generally described above. The PDHMS pressure measurement is then transmitted to the PDHMS panel 134 and conveyed first to the RTU 128 and ultimately the computer system 130 so that it may be recorded and stored by the appropriate subsystem. The method 300 may further include, adjusting the operational position of the gas lift choke 120 and monitoring the reciprocal change in the downhole pressure, as at 304. In doing so, the computer system 130 software may enable the gas lift choke 120 to incrementally adjust across a predetermined range of operational positions while the PDHMS continues to measure downhole pressure. The operational positions of the gas lift choke 120 and the corresponding downhole pressures may then be transmitted to the RTU 128, and the RTU 128 transmits the data to the software system so that it may be recorded.

The method 300 may include plotting the downhole pressure against the operational position of the gas lift choke 120 in a graphical representation, as at 306. The plotting module 222 within the computer system 130 software enables the plotting of the acquired data. Lastly, the method 300 may include determining the optimum operational position of the choke 120 based on the point of lowest observed pressure indicated by the plot, as at 308. The computer system 130 software identifies the lowest downhole pressure and the corresponding operational position of the choke 120 when the lowest downhole pressure is observed or achieved. This point represents the point of optimum injection of the lift gas 122 and thus the optimum operational position of the gas lift choke 120.

Embodiments disclose herein include:

A. A method of calibrating gas lift injection for a gas lift well, the method including incrementally adjusting an operational position of a gas lift choke arranged within a gas lift injection line, the gas lift injection line being in fluid communication with an annulus defined between production tubing and an inner wall of a wellbore, and the gas lift choke being operable to control a flowrate of a lift gas injected into the annulus. The method further including monitoring changes in a real-time downhole pressure within the gas lift well as the operational position of the gas lift choke is adjusted and determining an optimized operational position of the gas lift choke based on a lowest downhole pressure and a corresponding operational position of the gas lift choke when the lowest downhole pressure is observed. Lastly, the method includes adjusting the operational position of the gas lift choke to the optimized operational position.

B. A well system, including a wellbore that penetrates a hydrocarbon-bearing formation and production tubing extended into the wellbore and in fluid communication with formation fluids emanating from the hydrocarbon-bearing formation. The well system further includes a gas lift choke arranged within a gas lift injection line, the gas lift injection line being in fluid communication with an annulus defined between the production tubing and an inner wall of the wellbore, and the gas lift choke being operable to control a flowrate of a lift gas injected into the annulus. Additionally, the well system includes a remote terminal unit (RTU) that receives a real-time downhole pressure measurement and a real-time operational position of the gas lift choke and a computer system that receives the real-time downhole pressure measurement and the real-time operational position of the gas lift choke from the RTU. The computer system including one or more processors and a memory for storing data and computer-readable instructions executable by the processors. Further, the computer system being programmed to process the real-time downhole pressure measurement and the real-time operational position of the gas lift choke and determine an optimized operational position of the gas lift choke based on a lowest downhole pressure and a corresponding operational position of the gas lift choke when the lowest downhole pressure is observed. The computer system being also programmed to send a command signal to the gas lift choke to adjust the operational position of the gas lift choke to the optimized operational position of the gas lift choke once the lowest downhole pressure is observed.

C. A non-transitory, computer readable medium programmed with computer executable instructions that, when executed by a processor of a computer system, perform a method of calibrating gas lift injection for a gas lift well, the method including incrementally adjusting an operational position of a gas lift choke arranged within a gas lift injection line, the gas lift injection line being in fluid communication with an annulus defined between production tubing and an inner wall of a wellbore, and the gas lift choke being operable to control a flowrate of a lift gas injected into the annulus. The method further including monitoring changes in a real-time downhole pressure within the gas lift well as the operational position of the gas lift choke is adjusted and determining an optimized operational position of the gas lift choke based on a lowest downhole pressure and a corresponding operational position of the gas lift choke when the lowest downhole pressure is observed. Additionally, the method includes adjusting the operational position of the gas lift choke to the optimized operational position.

Each of embodiments A, B, and C may have one or more of the following additional elements in any combination: Element 1: wherein the gas lift well includes a remote terminal unit (RTU) in communication with a computer system, and wherein monitoring changes in the real-time downhole pressure comprises: monitoring the changes in the real-time downhole pressure with the RTU; and communicating the changes in the real-time downhole pressure to the computer system. Element 2: wherein determining the optimized operational position of the gas lift choke comprises processing with the computer system the changes in the real-time downhole pressure in view of corresponding real-time operational positions of the gas lift choke. Element 3: further comprising: generating with the computer system a plot of the real-time downhole pressure against the corresponding real-time operational positions of the gas lift choke; and determining the optimized operational position of the gas lift choke corresponding to a lowest downhole pressure graphically represented on the plot. Element 4: wherein monitoring the changes in the real-time downhole pressure further comprises acquiring the real-time downhole pressure using a permanent downhole measurement system in communication with the RTU. Element 5: wherein adjusting the operational position of the gas lift choke to the optimized operational position comprises: generating a command signal with the computer system; and adjusting the operational position of the gas lift choke to the optimized operational position of the gas lift choke upon receipt of the command signal. Element 6: wherein the gas lift well further includes a motor operatively coupled to the gas lift choke and in communication with the computer system, the method further comprising sending the command signal to the motor with the computer system.

Element 7: wherein the computer system is further programmed to incrementally adjust the operational position of the gas lift choke while simultaneously recording the real-time downhole pressure measurement. Element 8: wherein the real-time downhole pressure measurement is acquired by a permanent downhole monitoring system (PDHMS) in communication with the RTU. Element 9: further comprising a PDHMS panel in communication with the RTU to display measurements and operational positions of the gas lift choke obtained by the RTU from the PDHMS and the gas lift choke, respectively. Element 10: further comprising a motor operatively coupled to the gas lift choke and in communication with the computer system, wherein the motor is operable to selectively adjust the operational position of the gas lift choke upon receiving the command signal from the computer system. Element 11: wherein the computer system is further programmed to generate a plot of the real-time downhole pressure measurements and the real-time operational position of the gas lift choke, and wherein the optimized operational position of the gas lift choke corresponds to the lowest downhole pressure graphically represented on the plot. Element 12: wherein the computer system is further programmed to recognize changes in the optimized operational position of the gas lift choke and generate a proposed action that is presented to an operator.

Element 13: wherein adjusting the operational position of the gas lift choke to the optimized operational position comprises: generating a command signal with the computer system; and adjusting the operational position of the gas lift choke to the optimized operational position of the gas lift choke upon receipt of the command signal. Element 14: wherein adjusting the operational position of the gas lift choke to the optimized operational position comprises: generating a command signal with the computer system; and adjusting the operational position of the gas lift choke to the optimized operational position of the gas lift choke upon receipt of the command signal. Element 15: wherein the gas lift well further includes a motor operatively coupled to the gas lift choke and in communication with the computer system, the method further comprising sending the command signal to the motor with the computer system. Element 16: wherein determining the optimized operational position of the gas lift choke comprises processing with the computer system the changes in the real-time downhole pressure in view of corresponding real-time operational positions of the gas lift choke. Element 17: further comprising: generating with the computer system a plot of the real-time downhole pressure against the corresponding real-time operational positions of the gas lift choke; and determining the optimized operational position of the gas lift choke corresponding to a lowest downhole pressure graphically represented on the plot.

By way of non-limiting example, exemplary combinations applicable to A, B and C include: Element 1 with Element 2; Element 2 with Element 3; Element 1 with Element 4; Element 5 with Element 6; Element 8 with Element 9; Element 13 with Element 14; Element 15 with Element 16; and Element 16 with Element 17.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A method of optimizing gas lift injection for a gas lift well, the method comprising:

calibrating gas lift injection for the gas lift well by:

incrementally adjusting an operational position of a gas lift choke arranged within a gas lift injection line in fluid communication with an annulus defined between production tubing and an inner wall of a wellbore, the gas lift choke being operable to control a flowrate of a lift gas injected into the annulus;

monitoring changes in a real-time downhole pressure within the gas lift well as the operational position of the gas lift choke is adjusted; and creating a model based on the changes in the real-time downhole pressure as the operational position of the gas lift choke is adjusted and thereby determining an optimum lift gas injection point; and operating the gas lift well and selectively adjusting the operational position of the gas lift choke to thereby determine an optimized operational position of the gas lift choke that achieves the optimum lift gas injection point.

2. The method of claim 1, wherein the gas lift well includes remote terminal unit (RTU) in communication with a computer system, and wherein monitoring changes in the real-time downhole pressure comprises:

monitoring the changes in the real-time downhole pressure with the RTU; and communicating the changes in the real-time downhole pressure to the computer system.

3. The method of claim 2, further comprising determining the optimized operational position of the gas lift choke by processing with the computer system the changes in the real-time downhole pressure in view of corresponding real-time operational positions of the gas lift choke.

4. The method of claim 3, further comprising:

generating with the computer system a plot of the real-time downhole pressure against the corresponding real-time operational positions of the gas lift choke; and determining the optimized operational position of the gas lift choke corresponding to a lowest downhole pressure graphically represented on the plot.

5. The method of claim 2, wherein monitoring the changes in the real-time downhole pressure further comprises acquiring the real-time downhole pressure using a permanent downhole measurement system in communication with the RTU.

6. The method of claim 1, wherein selectively adjusting the operational position of the gas lift choke comprises:

generating a command signal with a computer system; and adjusting the operational position of the gas lift choke upon receipt of the command signal.

7. The method of claim 6, wherein the gas lift well further includes a motor operatively coupled to the gas lift choke and in communication with the computer system, the method further comprising sending the command signal to the motor with the computer system.

8. A well system, comprising:

production tubing extended into a wellbore and in fluid communication with formation fluids emanating from a hydrocarbon-bearing formation penetrated by the wellbore;

a gas lift choke arranged within a gas lift injection line in fluid communication with an annulus defined between the production tubing and an inner wall of the wellbore, the gas lift choke being operable to control a flowrate of a lift gas injected into the annulus;

a remote terminal unit (RTU) that receives a real-time downhole pressure measurement and a real-time operational position of the gas lift choke; and a computer system that receives the real-time downhole pressure measurement and the real-time operational position of the gas lift choke from the RTU, the computer system including one or more processors and a memory for storing data and computer-readable instructions executable by the processors, the computer system being programmed to:

calibrate gas lift injection for the wellbore by incrementally adjusting an operational position of the gas lift choke while simultaneously monitoring changes in the real-time downhole pressure;

create a model based on the changes in the real-time downhole pressure to determine an optimum lift gas injection point corresponding to a lowest downhole pressure observed in the wellbore;

process the real-time downhole pressure measurement and the real-time operational position of the gas lift choke during normal operation of gas lift within the wellbore;

determine an optimized operational position of the gas lift choke based on the lowest downhole pressure and a corresponding operational position of the gas lift choke when the lowest downhole pressure is observed; and send a command signal to the gas lift choke to selectively adjust the operational position of the gas lift choke to the optimized operational position of the gas lift choke once the lowest downhole pressure is observed and thereby achieving the optimum lift gas injection point.

9. The well system of claim 8, wherein the real-time downhole pressure measurement is acquired by a permanent downhole monitoring system (PDHMS) in communication with the RTU.

10. The well system of claim 9, further comprising a PDHMS panel in communication with the RTU to display measurements and operational positions of the gas lift choke obtained by the RTU from the PDHMS and the gas lift choke, respectively.

11. The well system of claim 8, further comprising a motor operatively coupled to the gas lift choke and in communication with the computer system, wherein the motor is operable to selectively adjust the operational position of the gas lift choke upon receiving the command signal from the computer system.

12. The well system of claim 8, wherein the computer system is further programmed to generate a plot of the real-time downhole pressure measurements and the real-time operational position of the gas lift choke, and wherein the optimized operational position of the gas lift choke corresponds to the lowest downhole pressure graphically represented on the plot.

13. The well system of claim 8, wherein the computer system is further programmed to recognize changes in the optimized operational position of the gas lift choke and generate a proposed action that is presented to an operator.

14. A non-transitory, computer-readable medium programmed with computer-executable instructions that, when executed by a processor of a computer system, cause the processor to:

calibrating gas lift injection for a gas lift well by:

incrementally adjusting an operational position of a gas lift choke arranged within a gas lift injection line in fluid communication with an annulus defined between production tubing and an inner wall of a wellbore, the gas lift choke being operable to control a flowrate of a lift gas injected into the annulus;

monitoring changes in a real-time downhole pressure within the gas lift well as the operational position of the gas lift choke is adjusted; and creating a model based on the changes in the real-time downhole pressure as the operational position of the gas lift choke is adjusted and thereby determining an optimum lift gas injection point; and operating the gas lift well and selectively adjusting the operational position of the gas lift choke to thereby determine an optimized operational position of the gas lift choke that achieves the optimum lift gas injection point.

15. The non-transitory, computer-readable medium of claim 14, wherein to adjust the operational position of the gas lift choke to the optimized operational position the processor is operable to:

generate a command signal to adjust the operational position of the gas lift choke to the optimized operational position of the gas lift choke.

16. The non-transitory, computer-readable medium of claim 15, wherein the gas lift well further includes a motor operatively coupled to the gas lift choke and in communication with the computer system, and wherein the processor is operable to transmit the command signal to the motor.

17. The non-transitory, computer-readable medium of claim 14, wherein the gas lift well includes a remote terminal unit (RTU) in communication with the computer system, and wherein to monitor changes in the real-time downhole pressure the processor is operable to receive the changes in the real-time downhole pressure from the RTU.

18. The non-transitory, computer-readable medium of claim 17, wherein to determine the optimized operational position of the gas lift choke the processor is operable to process the changes in the real-time downhole pressure in view of corresponding real-time operational positions of the gas lift choke.

19. The non-transitory, computer-readable medium of claim 18, wherein the processor is operable to:

generate a plot of the real-time downhole pressure against the corresponding real-time operational positions of the gas lift choke; and determine the optimized operational position of the gas lift choke corresponding to a lowest downhole pressure graphically represented on the plot.

* * * * *